United States Patent [19]

Baker et al.

[11] 3,935,085

[45] Jan. 27, 1976

[54] COMPOSITION CONTROL OF AN ELECTROCOATING BATH

[75] Inventors: Jr. Baker, Pleasanton; Willard J. Springer, Livermore, both of Calif.

[73] Assignee: Kaiser Aluminum & Chemical Corporation, Oakland, Calif.

[22] Filed: Mar. 6, 1974

[21] Appl. No.: 448,597

[52] U.S. Cl. ..... 204/181

[51] Int. Cl.[2] ..... C25D 13/06

[58] Field of Search ..... 204/181

[56] References Cited

UNITED STATES PATENTS 3,663,403 5/1972 Christenson ..... 204/181

*Primary Examiner*—Howard S. Williams

*Attorney, Agent, or Firm*—Paul E. Calrow; Edward J. Lynch

[57] ABSTRACT

This invention relates to a method of controlling the composition of an electrocoating bath, and, in particular, the neutralization agent content of such a bath wherein the electrocoating current is sensed and in accordance therewith a particular amount of ultrafilter permeate is discarded.

4 Claims, 3 Drawing Figures

COMPOSITION CONTROL OF AN ELECTROCOATING BATH

BACKGROUND OF THE INVENTION

This invention generally relates to an improved method of electrocoating water-soluble or water-dispersible coating resins onto a conductive surface and specifically to the control of amines in an amine neutralized polycarboxylic acid resin system, such as is taught in U.S. Pat. Nos. 3,230,162; 3,382,165; and the like.

Electrodeposition of water-based coatings, commonly termed electrocoating, is a coating process which has many advantages over other coating methods, such as spraying, dipping, rolling and the like. The advantages are numerous. The process deposits a film of uniform thickness on essentially any conductive surface even those having sharp points and edges. The electrocoated film applied is relatively water-free, and thus will not run or drip when taken out of the bath. Because little or no organic solvents are used in resin systems, the process is essentially fumeless and requires no extensive fume collection and incineration equipment. This latter point is important in view of the increased concern over environmental pollution. An additional advantage is the fact that a second or top coat can be applied over the electrocoated film without curing the electrocoated film and both coats can be cured in one baking operation. By eliminating the necessity of two furnaces, the cost of a two-coat process can be considerably reduced.

The electrocoating process generally comprises immersing the article to be coated into the electrocoating bath, usually as an anode, and passing a current through the bath between the article and an electrode. The process is usually self-arresting in that as the thickness of the coating increases, the resistance thereof also increases, thereby decreasing the electrodeposition rate.

Most commercially available resins for anodic electrocoating generally are polycarboxylic acid-based resins, such as those described in the previously mentioned patents which issued to Gilchrist. To solubilize the resins, usually the resin is completely or nearly completely neutralized by a base, such as an organic amine, such as diisopropanolamine, dimethylethanolamine, triethylamine or ammonium hydroxide or other suitable base, such as KOH, LiOH and NaOH. During electrocoating when the polycarboxylic acid-based resin is electrodeposited, the organic amine or other neutralizing agent is released taking on a hydrogen ion and is driven to the cathode where $H_2$ is usually liberated. The organic amine or other neutralizing agent is not deposited in the coating and will stay in the bath except for small amounts which may be lost through dragout. Unless removed, the neutralizing agent will gradually build up in the bath and interfere with the electrocoating process. To remove the neutralizing agent and other low molecular materials, the bath is usually passed through an ultrafilter or other suitable device. For an excellent discussion on the use of ultrafilters in the purification of an electrocoating bath, see the article "Ultrafiltration of Electrocoating Systems," in Nonpolluting Coatings and Coating Processes, Plenum Press, (1973) edited by J. L. Gardon and J. W. Prane and the article written by A. S. Michaels in Chemical Engineering Progress, Vol. 64, No. 12, 31–43.

Prior methods of controlling the neutralizing agent and other components in the electrocoating bath generally comprise determining the concentration of neutralizing agent and other components in the bath and then discarding a particular amount of the ultrafilter permeate for those components in excess, such as organic amines, and adding components, such as solubilizing or coupling agents and deionized water in which the bath is deficient. Usually, deionized water must be added due to the water which is discarded with the permeate. However, unless the analysis and permeate disposal is done frequently, a considerable variation in the amine level and other components can result, thus seriously interfering with the electrocoating operations. Frequent analysis is both troublesome and expensive.

Against this background, the present invention was developed.

DESCRIPTION OF THE INVENTION

This invention relates to automatically controlling the composition of an electrocoating bath, and, in particular, to a method of automatically controlling the content of the neutralization agent in an electrocoating bath containing polycarboxylic acid resin.

In accordance with the invention, the electrocoating current is sensed and in response to the sensed current, a predetermined amount of amine or other neutralization agent is removed from the system by discarding a particular amount of ultrafilter permeate, sometimes termed ultrafiltrate. The amount of excess neutralizing agent generated during electrocoating is directly related to the amount of polycarboxylic acid resin electrodeposited which in turn is directly related to the amount of current which passes through the electrocoating bath between anode and the cathode. Thus, by measuring the current, the amount of excess amine generated can be determined and this excess amount can be removed from the bath by passing the bath through an ultrafilter and then discarding a sufficient amount of the permeate to remove the desired amount of neutralizing agent. The permeate is primarily a dilute aqueous solution and thus discarded water is also lost for the bath system. Because the present invention provides for a relatively constant amine level, the ratio of amine to water in the permeate will remain relatively constant. Therefore, deionized water additions to the bath to compensate for the water loss in discarding permeate can also be controlled in accordance with the amount of current which passes through the cell. Resin solids, coupling or solubilizing agents and the like can be added in a similar fashion to provide complete bath composition control.

Figure 1:
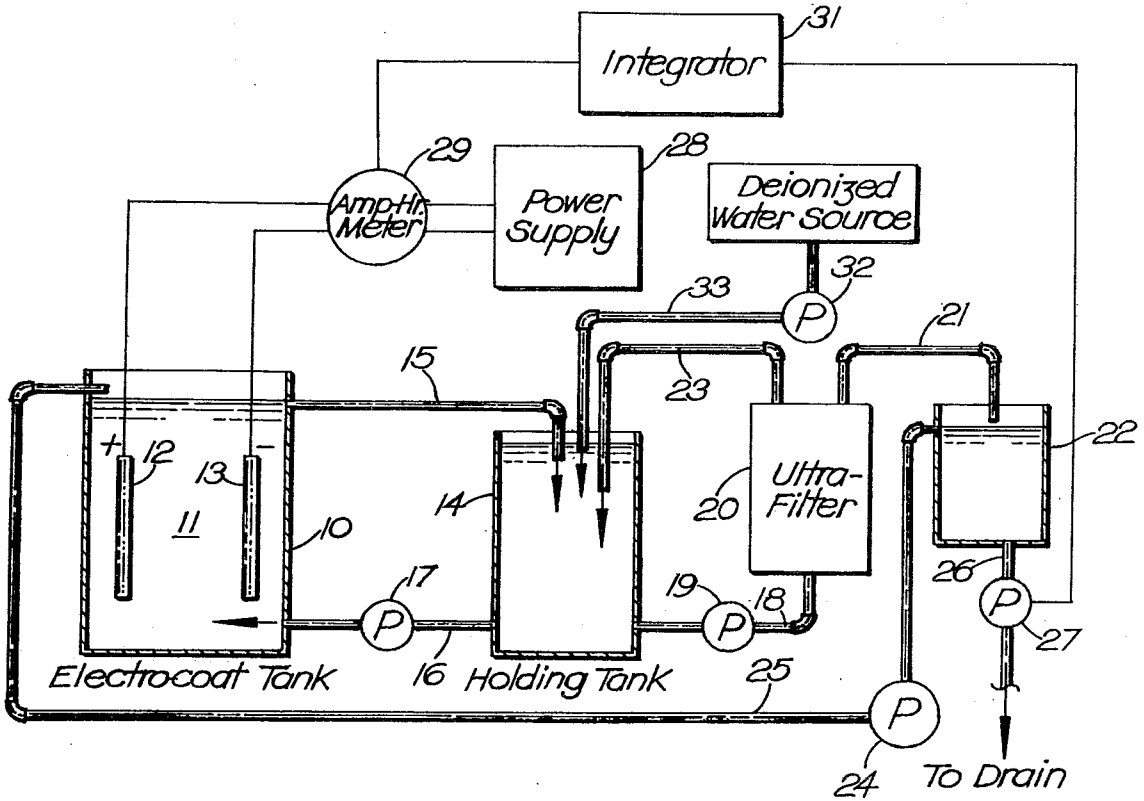
FIGS. 1, 2 and 3 generally are schematic drawings of various embodiments of the present invention.

Reference is made to FIG. 1 which schematically illustrates an embodiment of the present invention. The electrocoating tank 10 contains an aqueous bath comprising a dispersion or solution of polycarboxylic acid resin. Disposed in the bath 11 are at least two electrodes, an anode 12 and a cathode 13. Bath 11 overflows to holding tank 14 through conduit 15 wherein temperature and composition control can be exercised on the bath. The bath is recirculated back to the electrocoating tank 10 through conduit 16 by means of pump 17 to maintain a homogeneous bath. Bath is continuously or periodically removed from the holding tank 14 and transported through conduit 18 to ultrafilter 20 by means of pump 19. In ultrafilter 20, the low molecular materials, including neutralizing agents, are removed from the bath and transferred through conduit 21 to permeate holding tank 22. The thus-purified bath is returned to the holding tank 14 by way of conduit 23. The ultrafilter permeate overflow from holding tank 22 is returned through pump 24 and conduit 25 to the electrocoating tank 10. Permeate holding tank 22 is provided with a discharge line 26 which leads to a positive displacement pump 27. Direct current is supplied to the anode 12 and cathode 13 by means of the power supply unit 28. Amp hour meter 29 is provided to sense the current which passes between the anode 12 and the cathode 13. The output of amp hour meter 29 is directed through conductor 30 to integrator 31 which actuates the positive displacement pump 27 when total current flow reaches a predetermined amount. The pump 27 is preferably present to operate at a predetermined length of time so as to discharge a particular quantity of permeate and thus neutralization agents and other undesirable contaminants. the same signal can be used to actuate pump 40 which is preset to operate a predetermined length of time to add a particular amount of deionized water (the amount lost in discarded permeate) to the bath through conduit 41 to the holding tank 14.

In operation, the electrocoating bath is continuously recirculated from the electrocoating tank through conduit 15 to the holding tank 14 and then back to the electrocoating tank 10. This provides a homogeneous bath temperature and composition. Temperature control and composition control can be effected in the holding tank. Electrocoating bath is continuously withdrawn from the holding tank 14 and pumped to the ultrafilter 20 wherein the low molecular weight contaminant including neutralizing agents are removed from the aqueous bath which is then returned to the holding tank 14. Ultrafilter permeate is passed to the permeate holding tank 22 which continuously overflows with the overflow being returned to the electrocoating tank 10. As electrolysis proceeds, the amp hour meter measures the total amount of current which is passed over a particular time. The integrator continuously adds the amount of current until the total amount of amp hours reaches a predetermined amount at which time the integrator generates a signal which actuates the positive displacement pumps 27 and 40. The pumps are preset to operate a particular length of time and thereby discard a particular amount of permeate (and thus amine) and add a particular amount of deionized water. Other components, such as paint solids, coupling or solubilizing agents and the like, can be similarly added if desired.

Figure 2:
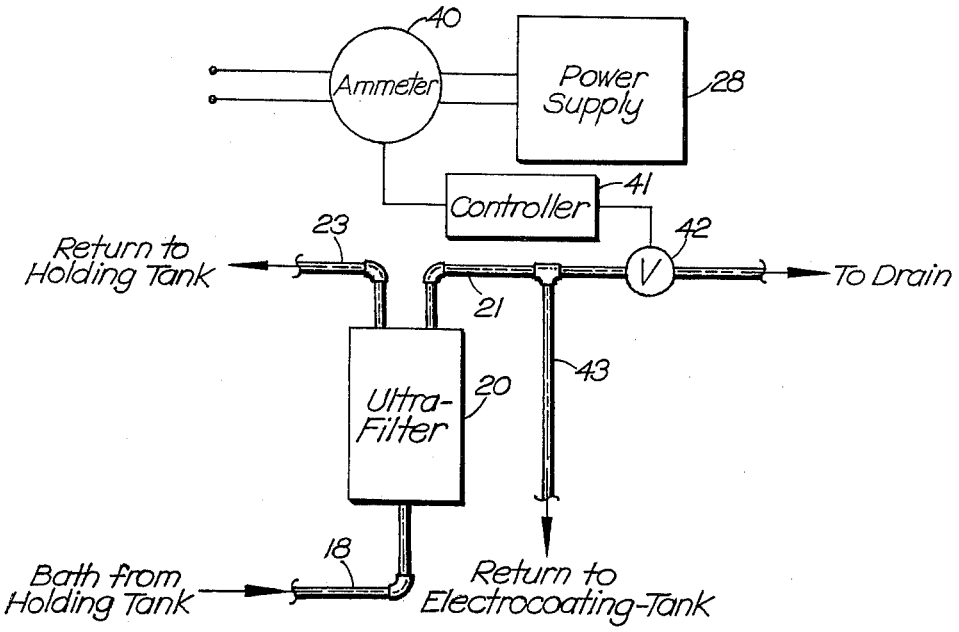
Figure 3:
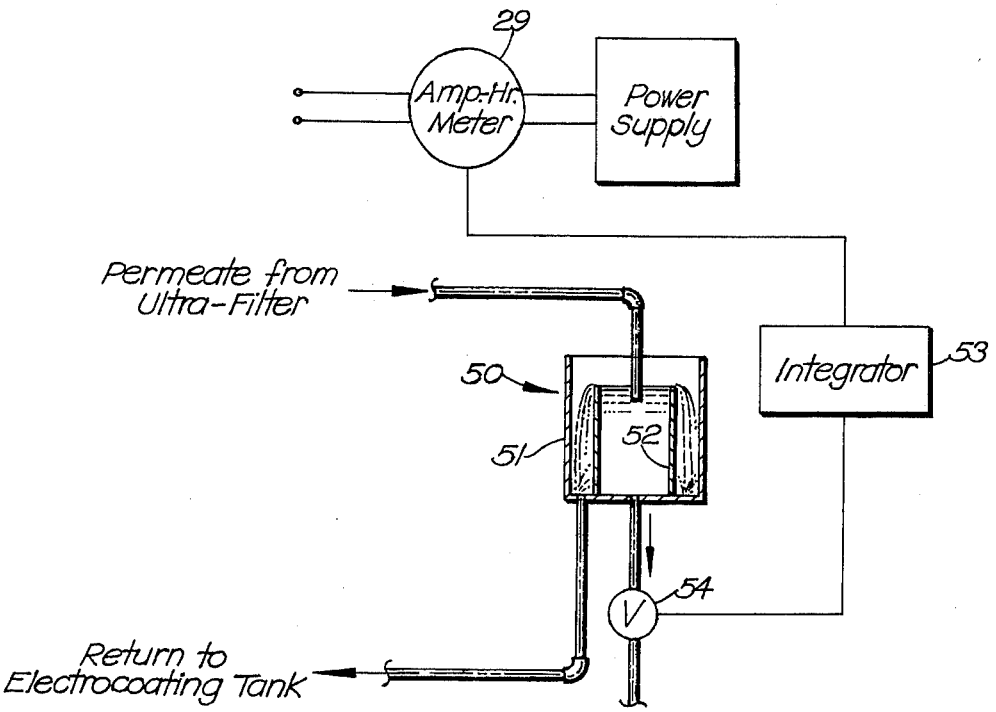

Alternative methods of discarding the permeate are shown in FIGS. 2 and 3. In FIG. 2, electrocoating current is sensed by amp meter 40 and in response to the current sense controller 41 adjust the automatic control valve 42 so as to control the rate of permeate discharge required by the current sensed. Excess permeate through conduit 43 can be returned to electrocoating tank 10 as shown in FIG. 1. In FIG. 3, the permeate is directed to a permeate handling unit 50 comprising an outer tank 51 and an inner tank 52. The permeate constantly overflows from inner tank 52 to outer tank 51. When the amp hour meter 29 has sensed a particular amount of current, the integrator 53 then actuates valve 54 so as to open same and remain open until the inner tank 52 is essentially drained. The valve 54 then closes and the cycle can repeat itself.

Although in the figures the excess permeate is shown as being returned to the electrocoating tank and the purified electrocoating purified coating bath from the ultrafilter is shown to be returned to the holding tank 14, in actuality, the two streams can be directed to either tank.

All of the control equipment necessary to perform the functions described above may be conventional equipment which can be readily selected by those skilled in the art. For example, a particularly desirable amp hour meter is Model No. VT 1355-500-50 manufactured and sold by Vari-Tech, Inc., of Grand Rapids, Michigan, which contains a means for generating a signal when a predetermined amp hour is reached. The generated signal can be used to activate a valve or pump and thus eliminate the need for a controller or equivalent various relays and timers in the embodiment shown in FIGS. 1 and 3.

The ultrafiltration unit is an integral part of the present invention because it is necessary to make the separation between the organic amine or other neutralization agent and the polycarboxylic acid coating resin. As described in the previously mentioned articles on ultrafiltration by Josefson et al and Michaels, ultrafiltration functionally resembles classical filtration. However, the process is a membrane separation process and because of this, the technology departs considerably from classical filtration. The membrane is generally constructed of synthetic polymers, preferably having anisotropic characteristics. Most commercially available membranes are constructed to have a thin skin layer with a submicroscopic porosity. The underlying support material in the membrane contains pores several magnitudes larger than the porosity of the skin layer. Therefore, any material which passes through the skin layer will not plug or foul the underlying porous structure. The ultrafiltrate or permeate will contain water and low molecular weight materials which in the present case will be low molecular weights solvents or coupling agents, organic amines or other neutralization agents, ionic species and low molecular resinous materials. Water-insoluble solvents generally will not be found in the permeate. The ionic species will usually be the chromates, phosphates and possibly chlorides which may be brought into the bath from the surface of the metal to be coated. A particularly suitable ultrafilter is manufactured and sold by the Elcoat Systems, Inc.

The following is an example of an embodiment of the process of the present invention wherein the electrocoating bath treating system is that shown in FIG. 1. The electrocoating process involved primer coating a continuous aluminum strip. Upon exiting from the bath, the strip was not rinsed but merely squeegeed to remove excess bath. About 200 gallons of bath is maintained in the electrocoating tank with the bath containing about 10% by weight of Lectropon, a polycarboxylic acid coating resin manufactured and sold by DeSoto, Inc. The holding tank contains about 400 gallons of bath and about 50 gallons per minute is recirculated between the two tanks. About 20 gallons per minute of bath is removed from the holding tank and passed under a pressure of 150 psi to an ultrafilter unit manufactured by the Elcoat Systems, Inc., having a filtration area of about 2.5 $ft^2$ and utilizing a 25A° membrane. About 50 milliliters per minute of permeate is discharged from the ultrafilter and passed to the permeate holding tank. About 45 gallons per minute of filtrate is returned from the ultrafilter to the holding tank. The permeate holding tank contains about 5 gallons of permeate. Current load during electrocoating averaged about 300 amps and every 44 amp hours the positive displacement pump is activated for 3–9 minutes to discharge all of the permeate in the permeate holding tank. This process of control maintains the excess amine concentration in the electrocoating bath within the range of 10.4 and 10.8 milliequivalents of amine. In this particular instance, the solubilizing amine was dimethylethanolamine.

It is obvious that various modifications and improvements can be made to the present invention without departing from the spirit thereof and the scope of the appended claims.

What is claimed is:

1. In the method of electrocoating metal products wherein the electrocoating bath contains polycarboxylic acid coating resin which has been at least partially neutralized with an agent selected from the group consisting of organic amines, ammonium hydroxide, potassium hydroxide, sodium hydroxide and lithium hydroxide and wherein electrocoating bath is passed through an ultrafilter so as to separate neutralization agent therefrom and at least part of the ultrafilter permeate containing neutralization agent is discarded, the improvement comprising a. sensing the electrocoating current; and b. discarding a predetermined amount of permeate containing the neutralization agent in accordance with the current sensed.

2. The method of claim 1 including adding a predetermined amount of water to said bath in accordance with the current sensed.

3. The method of claim 1 wherein the permeate containing the neutralization agent is discarded when the total current flow during a particular period exceeds a predetermined amount.

4. The method of claim 1 including adding a predetermined amount of bath component selected from the group consisting of resin, coupling agents and solubilizing agents in accordance with the current sensed.

* * * * *

UNITED STATES PATENT OFFICE
CERTIFICATE OF CORRECTION

PATENT NO. : 3,935,085
DATED : January 27, 1976
INVENTOR(S) : Bruce A. Baker, Jr. and Willard J. Springer It is certified that error appears in the above-identified patent and that said Letters Patent are hereby corrected as shown below:

Title Page, Inventor,"Jr. Baker" should be --Bruce A.Baker,Jr.--

Column 2, Line 31, "the" should be --this--

Column 2, Line 49, "for" should be --from--

Column 3, Line 21, "present" should be --preset--

Column 4, Line 54, "treating" should be --treatment--

Signed and Sealed this

*fourth* Day of *May 1976*

[SEAL]

*Attest:*

RUTH C. MASON
*Attesting Officer*

C. MARSHALL DANN
*Commissioner of Patents and Trademarks*